US005224589A

United States Patent [19]

Karakama et al.

[11] Patent Number: 5,224,589

[45] Date of Patent: Jul. 6, 1993

[54] OPERATING LEVER DEVICE

[75] Inventors: Tadao Karakama; Mitsumasa Akashi, both of Kanagawa, Japan

[73] Assignee: Kabushiki Kaisha Komatsu Seisakusho, Japan

[21] Appl. No.: 768,592

[22] PCT Filed: Jan. 31, 1991

[86] PCT No.: PCT/JP91/00123

§ 371 Date: Sep. 30, 1991

§ 102(e) Date: Sep. 30, 1991

[87] PCT Pub. No.: WO91/11817

PCT Pub. Date: Aug. 8, 1991

[30] Foreign Application Priority Data

Jan. 31, 1990 [JP] Japan ..... 2-18944
Jan. 31, 1991 [JP] Japan ..... 2-18945

[51] Int. Cl.[5] ..... H01H 3/00

[52] U.S. Cl. ..... 200/339; 200/335; 200/6 A; 74/471 XY; 341/20

[58] Field of Search ..... 200/329, 335, 338, 339, 200/6 A, 61.45 R, 61.52, 553; 273/148 B; 74/471 XY; 338/128; 341/20; 340/709, 706

[56] References Cited

U.S. PATENT DOCUMENTS

| | | | |
|---|---|---|---|
| 3,308,675 | 3/1967 | Jonsoon | 200/6 A |
| 3,666,900 | 5/1972 | Rothweiler et al. | 200/6 A |
| 3,827,313 | 8/1974 | Kiessling | 74/471 XY |
| 4,309,582 | 1/1982 | Coors | 200/335 X |
| 4,492,830 | 1/1985 | Kim | 200/553 X |
| 4,614,847 | 9/1986 | Sasao | 200/553 X |
| 4,654,576 | 3/1987 | Oelsch et al. | 200/6 A X |
| 4,812,802 | 3/1989 | Nishiumi et al. | 338/128 |
| 4,849,583 | 7/1989 | Meyer | 74/471 XY X |
| 5,065,146 | 11/1991 | Garrett | 273/148 B X |
| 5,107,080 | 4/1992 | Rosen | 200/6 A |
| 5,140,320 | 8/1992 | Gerbier et al. | 74/471 XY |

FOREIGN PATENT DOCUMENTS

| | | | |
|---|---|---|---|
| 3930754 | 4/1991 | Fed. Rep. of Germany | 200/329 |
| 2574588 | 6/1986 | France | 273/148 B |
| 64-31420 | 2/1989 | Japan . | |
| 1-65105 | 4/1989 | Japan . | |
| 275176 | 11/1990 | Japan | 74/471 XY |
| 2235762 | 3/1991 | United Kingdom | 74/471 XY |

*Primary Examiner*—Henry J. Recla
*Assistant Examiner*—Glenn T. Barrett
*Attorney, Agent, or Firm*—Ronald P. Kananen

[57] ABSTRACT

An operating lever device constructed such that the members thereof having a comparatively high rigidity can be used in such a way as to minimize the wear-down thereof and enable the angle of inclination of the lever to be detected precisely over a long period of time. The operating lever device is arranged such that any one of a plurality of rod members (22) which are inserted slidably while they are constantly urged upward into the device body (10) can be pushed down by the tilting of a lever (20) so as to rotate either a first shaft (23) or a second shaft (24) through a retaining member (27) or (28) held in contact with the lower end of the rod member (22). Thus, the angle of inclination of the lever (20) can be detected precisely by either one of rotational angle sensors (25, 26) mounted on at least one end of each of the first and second shafts.

14 Claims, 8 Drawing Sheets

OPERATING LEVER DEVICE

TECHNICAL FIELD OF THE INVENTION

This invention relates to an operating lever device for detecting the angle of inclination of the operating lever by means of a rotational angle sensor and for outputting it as an electric signal.

BACKGROUND ART OF THE INVENTION

As an operating lever device of the kind specified, the device described in Japanese Laid-Open Utility Model Application NO. SHO 62-140636 is known.

Briefly, as shown in FIGS. 1 and 2 the above-mentioned prior art includes an operating lever 2 which is mounted on the device body 1 by means of a universal coupling 3 so as to allow it to be tilted in either X direction or Y direction. The above-mentioned device body 1 is provided with a first pair of rotational angle sensors 4, 4 in the X direction and a second pair of rotational angle sensors 5, 5 in the Y direction. The rotating shafts of the first pair of rotational sensors 4, 4 being connected by means of a first gimbal 6, and the rotating shafts of the pair of second rotational angle sensors 5, 5 being operating lever 2 is disposed through elongated holes 6*a* and 7*a* formed in the first and second gimbals 6 and 7, respectively so that when the lever 2 is tilted, in the X direction the second gimbal 7 is pivoted so as to rotate the rotating shafts of the second pair of rotational angle sensors 5, 5, whilst when the lever 2 is tilted in the Y direction the first gimbal 6 is pivoted so as to rotate the rotating shafts of the first pair of rotational angle sensors 4, 4.

In the above-mentioned prior art operating lever device, if there is a clearance between the base portion 2*a* of the lever 2 and the elongated holes 6*a*, 7*a* of the first and second gimbals 6, 7, respectively, then the pivot amount of each of the first and second gimbals 6, 7 when the lever 2 is tilted does not correspond exactly to that of the lever 2 . Therefore it is necessary to hold the base portion 2*a* of the lever 2 constantly in contact with the elongated holes 6*a* and 7*a*, respectively. As a result, the base portion 2*a* of the lever 2 slides along either one of the elongated holes 6*a* and 7*a* of the first and second gimbals 6 and 7, respectively accordingly these sliding portions tend to wear down with the passing of time. When the sliding portions wear down, a clearance is created between the base portion 2*a* of the lever 2 and each of the elongated holes 6 and 7, so that the angle of inclination of the lever 2 cannot be detected precisely by means of the rotational angle sensors 4 and 5.

Further, the first and second gimbals 6 and 7 are each comprised of a thin-walled plate member which is bent substantially in a U-shape and which has a low rigidity. Therefore, when they are pivoted by the operating lever 2 they tend to flex in a manner wherein the angle of inclination of the operating lever 2 is not be transmitted accurately to the rotating shaft of each of the rotational angle sensors 4 and 5. This of course lowers the detection accuracy of the angle of inclination lever.

Further, since the first pair of rotational angle sensors 4, 4 in the X direction and the second pair of rotational angle sensors 5, 5 in the Y direction are mounted on the device body 1 while the rotating shafts 4*a*, 5*a* a thereof are connected to both ends of the first and second gimbals 6, 7, respectively, the first and second gimbals 6 and 7 are supported by their respective rotating shafts 4*a* and 5*a* so as to pivot freely. Therefore, it is difficult to locate each of the pairs of rotating shafts 4*a*, 4*a*, and 5*a*, 5*a* in alignment. If the accuracy of alignment is low, then the pivot centers of both ends of each of the gimbals 6 and 7 get out of alignment. Accordingly, of the gimbals 6, 7 cannot be swung smoothly and excessive forces are exerted thereon. Further when each of the gimbals 6, 7 is pivoted the angles of rotation of each of the pairs of rotating shafts 4*a*, 4*a* and 5*a*, 5*a* differ from one another, thereby lowering the detection accuracy of the angle of inclination of the operating lever 2.

SUMMARY OF THE INVENTION

The present invention has been made in view of the above-mentioned prior art drawbacks. An object of the present invention is to provide an operating lever device wherein the members thereof have a comparatively high rigidity which minimize the wear-down thereof and enable the angle of inclination of the lever to be detected precisely over a long period of time.

Another object of the present invention is to provide an operating lever device wherein unevenness in the operating lever inclination angle detecting portions, which result from working error of the members forming the lever device, can easily be corrected.

To achieve the above-mentioned objects, according to a first aspect of the present invention, there is provided an operating lever device comprising:

- a tiltable operating lever which is erected upright by screwing it into and through the central part of a circular disc whose lower end is connected through a universal coupling to the body of the device;
- four rod members which are mounted slidably in four blind holes, formed in the body at equal intervals and in a parallel and spaced relationship with one another and the axial direction of the body;
- means for urging the rod members towards the disc so as to constantly hold the upper end faces of these rod members in contact with the lower surface of the disc;
- first shaft having retaining pieces mounted on both sides thereof and which are constantly held in contact with the lower end faces of the rod members, respectively, forming an oppositely located pair out of the rod members, the first shaft being journaled rotatably at both ends in the lower walls of the body;
- a second shaft having retaining pieces, mounted on both sides thereof and which are constantly held in contact with the lower end faces of the rod members, respectively, forming another oppositely located pair out of the rod members, the second shaft being journaled rotatably at both ends in the lower walls of the body in a manner which does not interfere with the first shaft;
- a first rotational angle sensor connected to one of the ends of the first shaft; and
- a second rotational angle sensor connected to one end of the second shaft.

According to a second aspect of the present invention, there is provided an operating lever device of the nature set forth above, characterized in that the retaining piece on one side of the first shaft projects from a portion thereof near one end of the first shaft, the retaining piece on the other side of the first shaft projects from a portion thereof near the other end of the first shaft, the retaining piece on one side of the second shaft projects from a portion near one end of the second shaft and the retaining piece on the other side of the second shaft projects from a portion thereof near the other end of the second shaft.

Further, according to a third aspect of the present invention, there is provided an operating lever device of the nature set forth above, characterized in that the retaining piece on one side of the first shaft projects with an upward slope from a portion thereof near one end of the first shaft the retaining piece on the other side of the first shaft projects with a downward slope from a portion thereof near the other end of the first shaft, the retaining piece on one side of the second shaft projects with an upward slope from a portion thereof near one end of the second shaft, and the retaining piece on the other side of the second shaft projects with a downward slope from a portion near the other end of the second shaft.

Still further, according to a fourth aspect of the present invention, there is provided an operating lever device as set forth in the above-mentioned first aspect, characterized in that each of the first and second rotational angle sensors functions as a neutral switch.

Yet further, according to a fifth aspect of the present invention, there is provided an operating lever device as set forth in the above-mentioned second aspect, characterized in that the retaining pieces on both sides of the second shaft are projected upward by a predetermined height so as to be located at the same level as the retaining pieces of the first shaft.

Further, according to a sixth aspect of the present invention, there is provided an operating lever device as set forth in the above-mentioned third aspect, characterized in that the retaining pieces on both sides of the second shaft project upward by a predetermined amount so as to be located at the same height as the retaining pieces of the first shaft.

The above-mentioned and other objects, aspects and advantages of the present invention will become apparent to those skilled in the art by making reference to the following detailed description and the accompanying drawings in which preferred embodiments incorporating the principles of the present invention are shown by way of example only.

DETAILED DESCRIPTION OF PREFERRED EMBODIMENTS

Figure 1:
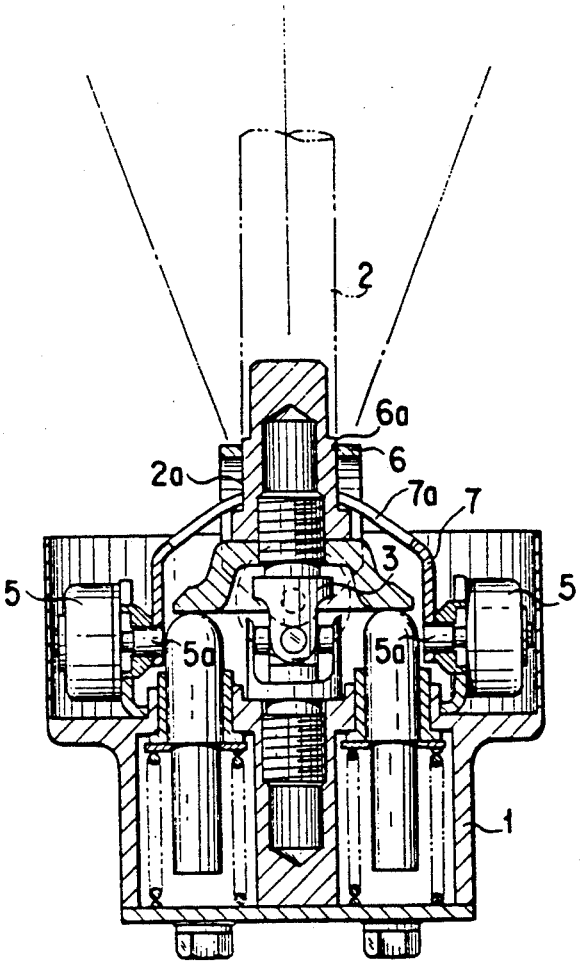
FIG. 1 PRIOR ART
FIGS. 1 and 2 are a longitudinal, sectional view and a top view of a prior art example of the operating lever device.
Figure 2:
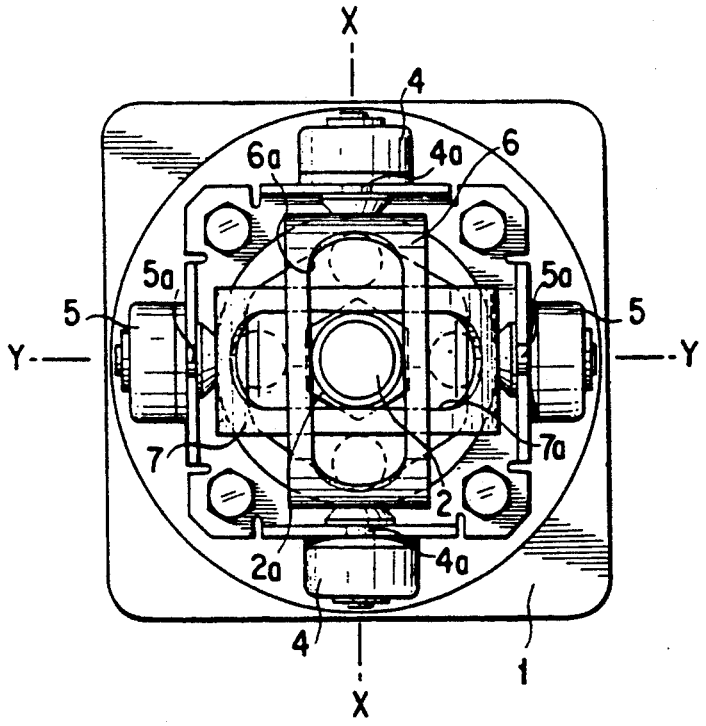
FIG. 2 PRIOR ART
Figure 3:
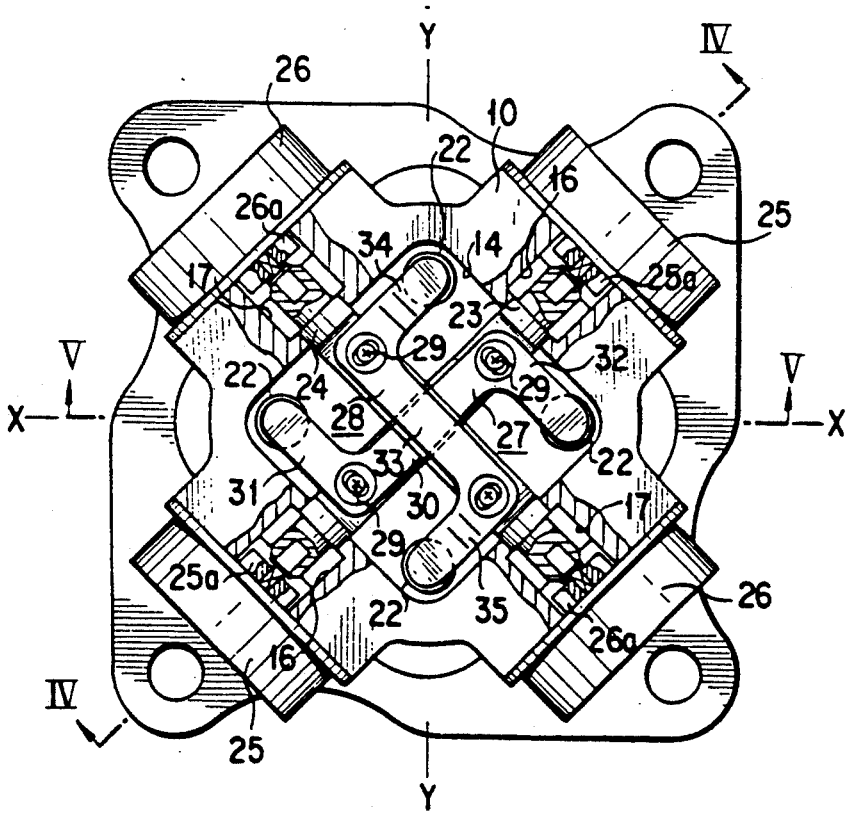
FIG. 3 is a bottom view of an embodiment of the operating lever device according to the present invention.
Figure 4:
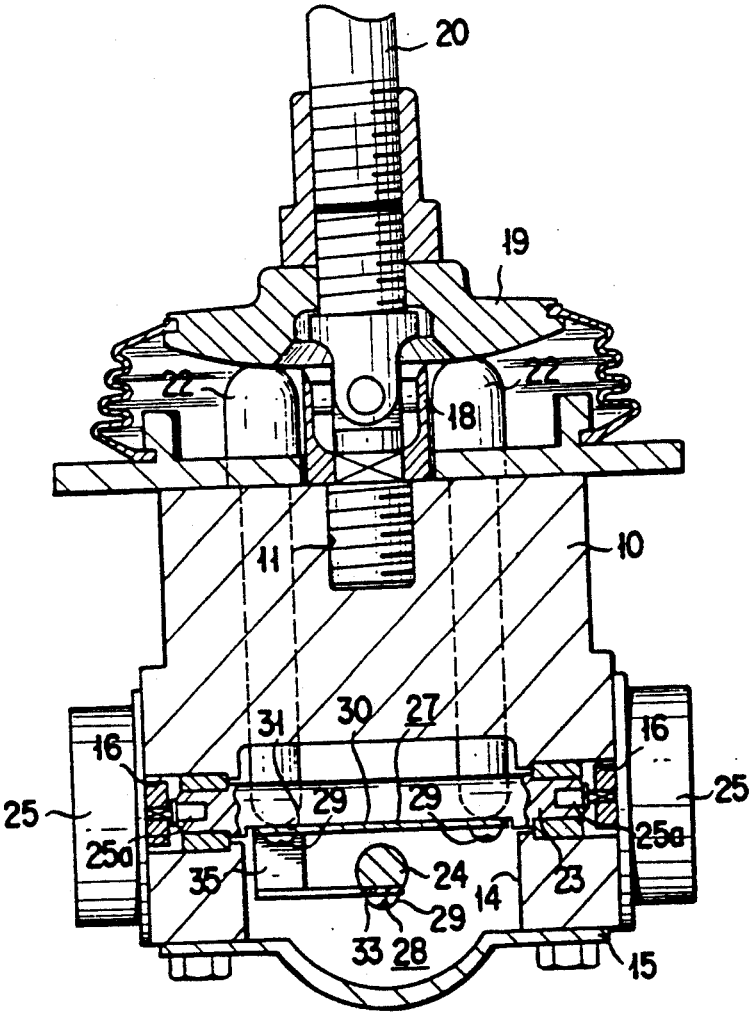
FIGS. 4 and 5 are longitudinal, sectional views taken along lines IV—IV and V—V of FIG. 3, respectively.
Figure 5:
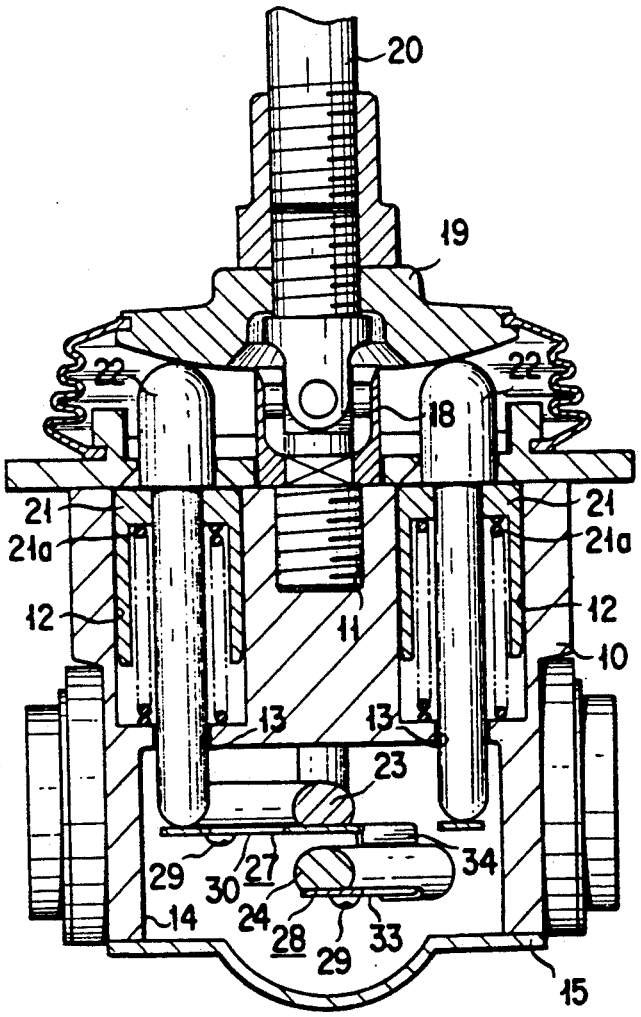
Figure 6:
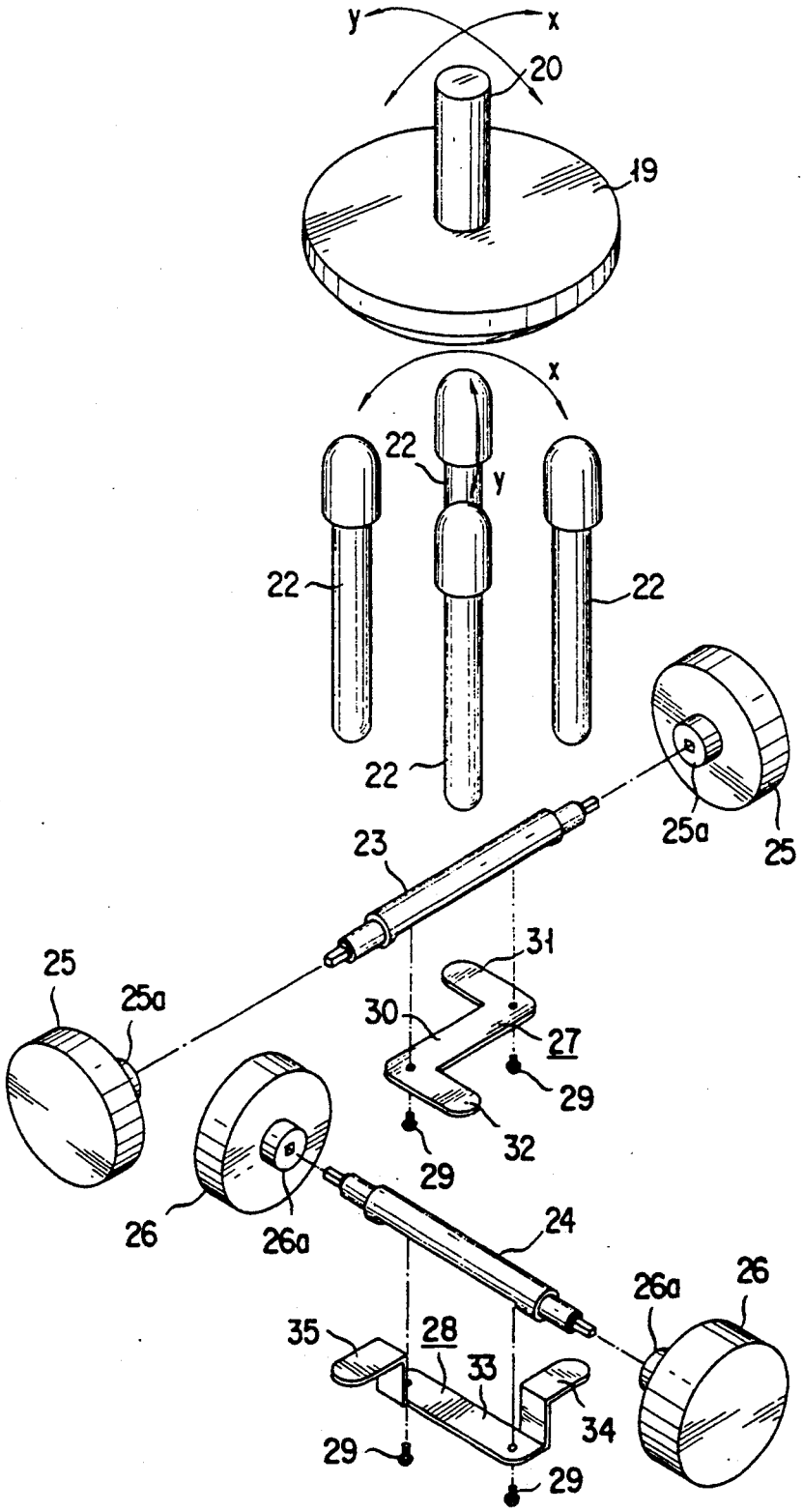
FIG. 6 is an exploded, perspective view showing principal elements constituting the embodiment shown in FIGS. 3, 4 and 5.

One embodiment and a number of variants of the present invention will now be described below with reference to the accompanying drawings (FIGS. 3 to 12).

FIGS. 3 to 6 show one embodiment of the present invention. As can be seen from these drawings, the body 10 of an operating lever device (which is referred to simply as "the body" below) 10 has a mounting screw-threaded bore 11 formed in the upper, central part thereof so as to open in the upper surface, and four longitudinal blind holes 12 having the same diameter, formed around the mounting screw-threaded bore 11 so as to extend in parallel relationship and at regular angular intervals of 90 degrees with one another. Each blind hole 12 has a through-hole 13 formed in the bottom thereof. The holes 13 open into a recess 14 formed in the lower, central part of the body 10, which is blocked by a cover 15. The lower side wall of the body 10 has pairs of first transverse holes 16, 16 and second transverse holes 17, 17 which open into the above-mentioned recess 14 and which are formed in vertically spaced apart relationship with each other and in opposed relationship with the central axis of the mounting screw-threaded hole 11.

A universal coupling 18 screwed in the mounting screw-threaded hole 11 of the above-mentioned body 10, is connected to a circular dish-shaped disc 19 and a lever 20, respectively. The disc 19 is tiltable freely together with the lever 20 either in X direction or in Y direction. A rod member 22 is inserted in each of the above-mentioned blind holes 12 so as to slide freely through the intermediary of a bush 21. The upper portion of each of these rod members 22 is urged upwardly by the resilient force of a spring **21*a* so as to abut against the lower surface of the aforementioned disc 19, whilst the lower portion of each of the rod members 22 passes through the aforementioned hole 13 and projects into the recess 14**.

Out of the above-mentioned four rod members 22, a first pair is located in opposed relationship with each other and arranged to respond to the tilting of the lever 20 in the X direction, while the remaining pair is arranged to respond to the tilting of the lever 20 in the Y direction.

Both ends of a first shaft 23 are inserted and supported rotatably in the above-mentioned pair of first transverse holes 16, 16, while both ends of a second shaft 24 are inserted and supported rotatably in the pair of second transverse holes 17, 17. The first and second shafts 23 and 24 are vertically spaced apart and arranged at 90 degrees to each other Further, rotatable shafts **25*a*, 25*a* of a pair of first rotational angle sensors 25, 25, are connected to both ends of the first shaft 23, while, rotatable shafts 26*a*, 26*a* of a pair of second rotational angle sensors 26, 26, are connected to both ends of the second shaft 24**.

Each of the above-mentioned first and second shafts 23 and 24 has a flat lower surface formed in the longitudinal, central part thereof. The flat lower surfaces of the first and second shafts 23 and 24 are fitted with a first retaining member 27 and a second retaining member 28, respectively, by means of screws 29. Each of the retaining members 27, 28 being substantially Z-shaped as seen in plan view. The first retaining member 27 is comprised of a mounting piece 30, a retaining piece 31 on one side of the mounting piece 30, and a retaining piece 32 on the other side thereof, all of which are formed integrally. The mounting piece 30 is mounted on the lower surface of the first first shaft 23 by means of the screws 29. The retaining pieces 31 and 32 are formed so as to project at right angles to the mounting piece 30 and in opposite directions with each other, and are held in contact with the lower ends of the pair of rod members 22 which is associated with the tilting of the above-mentioned lever 20 in the X direction.

In brief, the portions of each retaining piece and each rod member 22 to be held in contact therewith, are eccentric with respect to the axis of the first shaft 23.

The above-mentioned second retaining member 28 is formed in a similar manner, and is comprised of a mounting piece 33, a retaining piece 34 on one side of the mounting piece 33, and a retaining piece 35 on the other side thereof, all of which are formed integrally. The retaining piece 34 is formed so as to project upward from one end on one side of the mounting piece 33, whilst the retaining piece 35 projects upward from the other end on the other side thereof. The mounting piece 33 is mounted on the flat lower surface of the second shaft 24 by means of screws 29. The retaining pieces 34 and 35 are formed so as to project at right angles to the mounting piece 33 and in opposite directions with each other. The retaining pieces 34 and 35 are located vertically flush with the retaining pieces 31 and 32 formed on both sides of the above-mentioned first retaining member 27 and are held in contact with the lowermost portions of the retaining pair of rod members 22 which are associated with the tilting of the above-mentioned lever 20 in the Y direction.

Since the retaining piece 34 on one side of the second retaining member 28 and the retaining piece 35 on the other side thereof project upward, in spite of the fact that the second shaft 24 is located at a lower position than the first shaft 23, the retaining pieces 34 and 35 can be located vertically to same level as the retaining pieces 31 and 32. Therefore the length of the rod members 22 can be identical.

As an alternative, the second retaining member 28 may be formed so as to have the same shape as the first retaining member 27. In this case, the length of the rod members 22 which are held in contact with the retaining pieces 34, 35, are made longer than that of the other pair of rod members 22.

Thus, if the lever 20 is tilted in either one of X directions, then one of a pair of rod member 22 which is associated with this tilting, is pushed down by the disc 19, so that either the retaining piece 31 on one side of the first retaining member 27 or the retaining piece 32 on the other side thereof, is depressed. This rotation, the fist shaft 23 through an angle of rotation which is proportional to the angle of inclination of the lever 20, and thereby rotates the rotatable shafts **25*a* of the pair of first rotational angle sensors 25 to detect the angle of inclination of the above-mentioned lever 20**.

When the lever 20 is tilted in either one of the Y directions, either the retaining piece 34 on one side of the second retaining member 28 or the retaining piece 35 on the other side thereof is pushed down in the same manner as mentioned above by one of the pair of rod member 22 which is associated with this tilting, so as to rotate the second shaft 24, thereby rotating the rotating shafts **26*a* of the pair of second rotational angle sensors 26 to detect the angle of inclination of the above-mentioned lever 20**.

Next, several variant of the present invention will be described.

Figure 7:
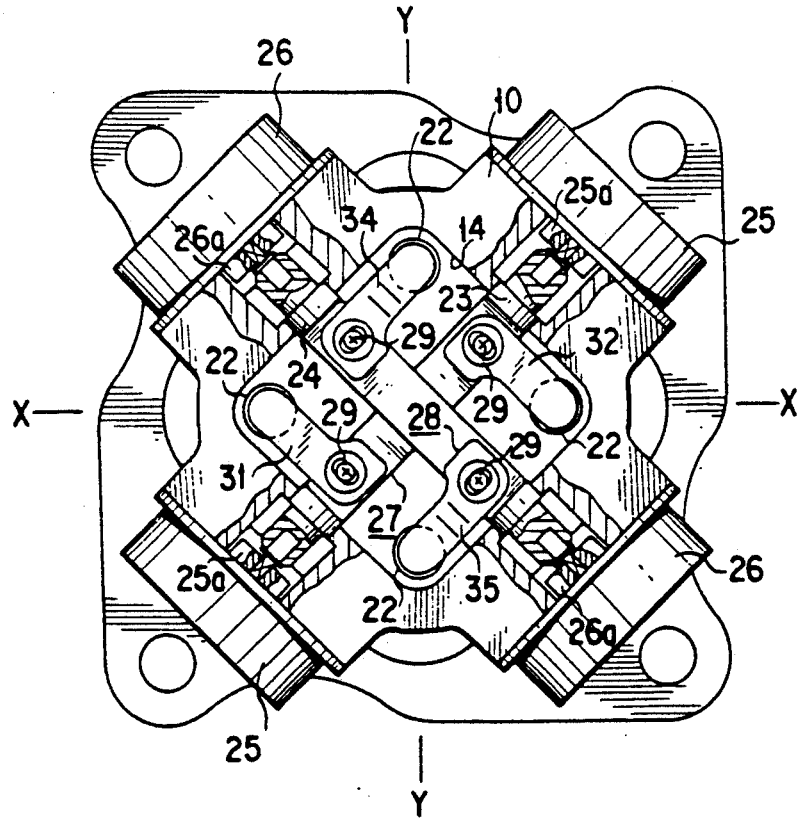
FIGS. 7, 8 and 9 are a bottom view, a partial perspective view and a fragmentary exploded view, respectively, showing first, second and third variants of the embodiment shown in FIG. 3.

According to a first variant shown in FIG. 7, a retaining piece 31 on one side of a first shaft 23 and a retaining piece 32 on the other side thereof are individually mounted on the shaft 23, whilst a retaining piece 34 on one side of a second shaft 24 and a retaining piece 35 on the other side thereof are individually mounted on the shaft 24.

Figure 8:
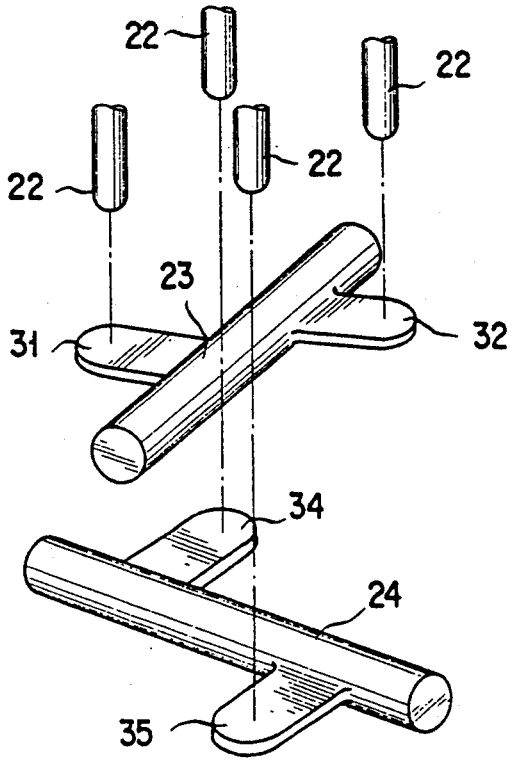

According to a second variant shown in FIG. 8, a first shaft 23 has retaining pieces 31 and 32 formed integrally therewith on both sides thereof, while a second shaft 24 has retaining pieces 34 and 35 formed integrally therewith on both sides thereof. With this arrangement, as both the shafts 23, 24 have essentially the same shape, one pair of opposed rod members 22 is required to be longer than the other pair.

Figure 9:
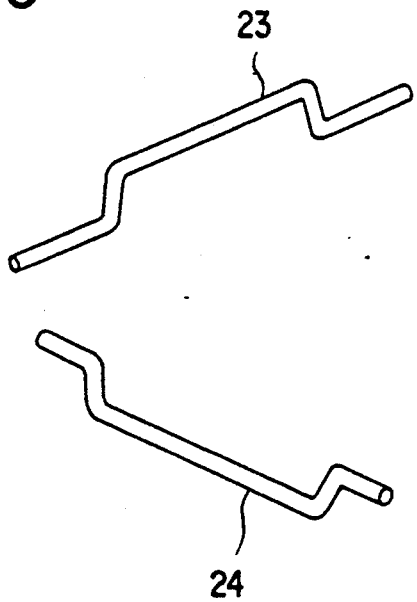

According to a third variant shown in FIG. 9, the longitudinal central portion of each of first and second shafts 23 and 24 is bent in U-shape. By so doing, the longitudinal both ends of the first and second shafts 23 and 24, respectively, can be located within the body 10 at the same level in the vertical direction.

In the above-mentioned embodiments, the pair of first rotational angle sensors 25, 25 is connected to the ends of the first shaft 23, and the pair of second rotational angle sensors 26, 26 is connected to the ends of the second shaft 24. However, a single first rotational angle sensor 25 may be connected to only one end of the first shaft 23 and a single second rotational angle sensor 26 may be connected to only one end of the second shaft 24.

That is to say, in case each shaft is provided with a pair of rotational angle sensors as in the prior art, one of the sensors is used as a neutral switch. However, if the sensor is a rotational angle sensor which can function as both as neutral switch and rotational angle sensor, it is only necessary to mount only one such sensor on each of the first and second shafts.

Next, a fourth variant of the present invention will be described with reference to FIGS. 10A, 10B, 11 and 12.

This fourth variant is obtained by improving the first and second retaining members of the embodiment disclosed with reference to FIGS. 3 to 6.

Figure 10A:
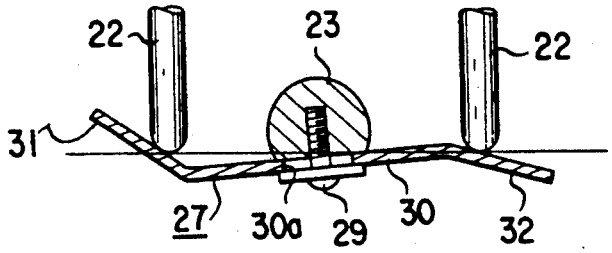
FIGS. 10A and 11 are fragmentary sectional views showing a fourth variants of the embodiments of FIG. 3.

That is to say; as shown in FIG. 10A, a first retaining member 27 is comprised of a mounting piece 30 having a retaining piece 31 of one side thereof. Each of the retaining pieces are and a retaining piece 32 on the other side thereof formed at the longitudinal ends of the mounting piece so as to project at right angles thereto and in opposite directions with each other. Further, the retaining piece 31 is inclined upward relative to the mounting piece 30, whilst the retaining piece 32 on the other side is inclined downward relative thereto. Both the retaining pieces 31 and 32 are formed integrally with the mounting piece 30. The mounting piece 30 is formed with an elongated transverse hole **30*a* through which screws 29 are screwed into the lower surface of the first shaft 23. The retaining piece 31 on one side of the mounting piece 30 and the retaining piece 32 on the other side thereof project and in opposite directions with each other and are held in contact with the lower ends of a pair of associated rod members 22, 22**, respectively.

Figure 11:
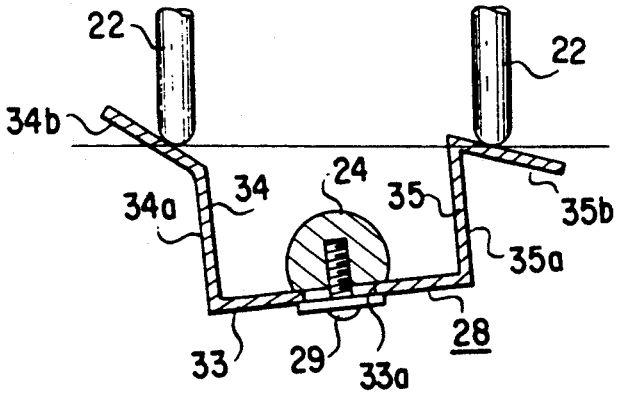

As shown in FIG. 11, a second retaining member 28 is comprised of a mounting piece 33 having a retaining piece 34 on one side thereof, and a retaining piece 35 on the other side thereof. The retaining pieces are formed integrally at the longitudinal ends of the mounting piece 33 so as to project at right angles thereto and in opposite directions with each other. The retaining piece 34 at one end of the mounting piece 33 is comprised of a rising piece 34*a* and a retaining end portion 34*b* and is of an upward hook-shape. The retaining end portion 34*b* is inclined upward. The retaining piece 35 at the other end of the mounting piece 33 is comprised of a rising piece 35*a* and a retaining end portion 35*b*, and is of an upward hook-shape. The retaining end portion 35*b* is inclined downward. The mounting piece 33 is formed with an elongated transverse hole 33*a* through which screws 29 are screwed into the lower surface of a second shaft 24. The retaining pieces 34 and 35 are formed so as to upwardly with respect to the second shaft 24 in an essentially parallel relationship and are held in contact with the lower ends of the remaining pair of associated rod members 22, 22, respectively.

With this variation, since each of the retaining piece 34 and 25 of the second retaining member 28 has an upward hook-shape the fact that the second shaft 24 is located at a lower position, than the first shaft is compensated for an all of the retaining pieces 31, 32, 34 and 35 of these shafts can be located at the same vertical level. As a result, the length of the rod members 22 can be made identical.

Alternatively, the second retaining member 28 may be formed in the same shape as the first retaining member 27. In this case, the length of the pair of rod members 22 which abut against the retaining pieces 34 and 35 of the second retaining member 28, is longer than that of the other pair of rod members 22.

Thus, when the lever 20 is tilted in either one of the X directions, one of a pair of rod members 22 is pushed down by the disc 19, so that either the retaining piece 31 on one side of the first retaining member 27 or the retaining piece 32 on the other side thereof is depressed by the rod member 22. This rotates the first shaft 23 through an angle of rotation which is proportional to the angle of inclination of the lever 20, thereby rotating the rotating shafts 25*a*, 25*a* of the pair of first rotational sensors 25, 25 to detect the angle of inclination of the above-mentioned lever 20.

When the lever 20 is tilted in either one of the Y directions, either the retaining piece 34 on one side of the second retaining member 28 or the retaining piece 35 on the other, side thereof is depressed by one of the pair of the associated rod member 22 so as to rotate the second shaft 24. This of course rotates the rotatable shafts 26*a* of the pair of second rotational angle sensors 26 to detect the angle of inclination of the above-mentioned lever 20.

In the above-mentioned configuration, it is essential that when the lever 20 is located at its neutral position the lower ends of the four pieces of rod members 22 abut against their associated retaining piece. However, it may occur that because of production errors the lower end of one of the pair of the rod members 22 can not abut against its associated retaining piece.

Figure 10B:
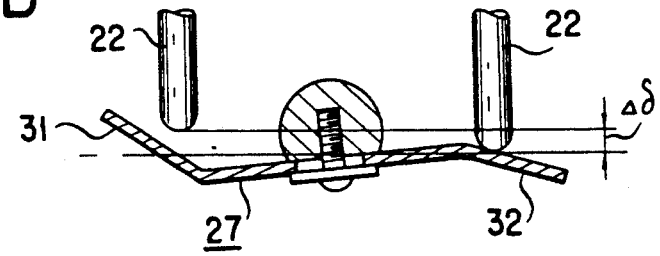
FIGS. 10B and 12 are explanatory views showing adjusting operations of a first retaining member in the fourth variant shown in FIG. 10A.
Figure 12:
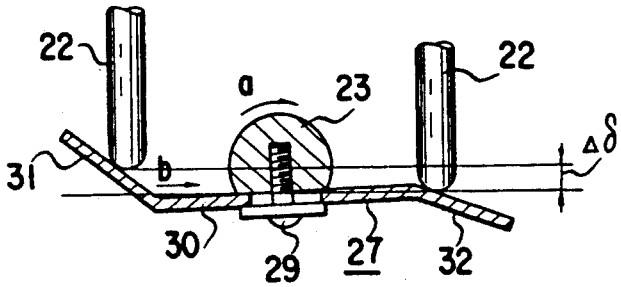

For example, as shown in FIG. 10B, the lower ends of a pair of rod members 22 which are located opposite to the first and second retaining pieces 31, 32, respectively, of the first retaining member 27, may get out of position vertically by an amount denoted by $\Delta\delta$. In such a case, as shown in FIG. 12, the screws 29 are loosened, and then the first shaft 23 is rotated in a direction shown by arrow "a", while the first retaining piece 31 is moved close to its associated rod member 22 by moving it to the right as shown by arrow "b". As a result, the first retaining member 27 is swung such that the first retaining piece 31 is moved toward the lower end of one of the rod members 22, while the second retaining piece 32 remains in position against the lower end of the other rod member 22. Thus, the first and second retaining pieces 31 and 32 can be adjusted into contact with the lower ends of the two pieces of rod members 22, 22, in the manner shown in FIG. 12.

In brief, in case the first and second retaining pieces 31 and 32 are formed in the same plane as the mounting piece 30, when the first retaining member 27 is swung together with the first shaft 23 in the direction shown by arrow "a", the first retaining piece 31 is moved toward to one of the rod members 22, while the second retaining piece 32 is moved away from the other rod member 22. However, with the fourth variant, since the first retaining piece 31 is inclined upward, both the retaining pieces 31 and 32 can be moved close to their associated rod members 22, respectively, by moving the first retaining member 27 to the right as shown by arrow "b" while swinging it in the direction shown by arrow "a".

Further, the same technique is applicable to the second retaining member 28.

It is only necessary to conduct the above-mentioned operation within the recess 14 by turning over the body 10 in which the rod members 22, the universal coupling 18, the disc 19 and the operating lever 20 are mounted.

In the above-described variant, while the pair of first rotational angle sensors 25, 25 are connected to both ends of the first shaft 23, and the pair of second rotational angle sensors 26, 26 are connected to both ends of the second shaft 24, the first and second shafts 23 and 24 may be provided at only one end thereof with one piece of first and second rotational angle sensors 25, 26, respectively.

That is to say; in case the operating lever device is provided with a pair of rotational angle sensors as in the case of the prior art, one of the pair of sensor is used as a neutral switch, however, if the sensor is a rotational angle sensor which can function both neutral switch and rotational angle sensor, it is only necessary to connect only one such sensor to each of the shafts.

As mentioned hereinabove, according to the present invention, the angle of inclination of the lever 20 is transmitted through one of the rod members 22, one of the retaining pieces and either the first shaft 23 or the second shaft 24 either to the first rotational angle sensor 25 or to the second rotational angle sensor 26 so that the angle of inclination of the lever 20 can be detected by means of either the first rotational angle sensor 25 or the second rotational angle sensor 26.

Further, since the arrangement is made such that one of the rod members 22 is slidably moved by the lever 20 so as to depress the associated retaining piece by the rod member 22 to thereby rotate either the first rotational angle sensor 25 or the second rotational angle sensor 26, the numbers of portions which wear down is reduced, and it becomes possible not only to detect the angle of inclination of the lever precisely over a long period of time, but also to increase the rigidity of the members forming the device to thereby eliminate any flexure of the same, so that the angle of inclination of the operating lever 20 can be detected precisely.

Further, as the first and second shafts 23 and 24 having a high rigidity are so as to be freely rotatable they can be rotated freely without causing any misalignment in centres, of rotation. Additionally, as the alignment of the rotating shafts 25a, 25a of the pair of first rotational angle sensors 25, 25 and the rotating shafts 26a, 26a of the pair of second rotational angle sensors 26, 26 can be made using the ends of each shaft as a reference or standard, the alignment accuracy can be enhanced readily when each of the first and second shafts is provided with a pair of rotational angle sensors.

Moreover, since the retaining pieces 31 and 34 on one side of the first and second retaining members 27 and 28, respectively, are inclined upward relative to their associated mounting pieces 30 and 33, while the retaining pieces 32 and 35 on the other side thereof are inclined downward relative to the mounting pieces 30 and 33, respectively, the retaining pieces 31 and 34 can be moved toward to their associated rod members 22 by moving the first and second retaining members 27 and 28, respectively. Therefore, even when the lower ends of the pair of rod members 22, 22 in opposed relationship with the retaining pieces of the first and second retaining members 27 and 28, respectively, are not flush with each other, the retaining pieces 31, 34 on one side of the first and second retaining members and the retaining pieces 32, 35 on the other side thereof can be brought into contact with the lower ends of the associated pairs of rod members 22, respectively.

What is claimed is:

1. An operating lever device comprising:

a body;

a tiltable operating lever which is erected upright by screwing in into and through a central part of a circular disc and which has a end connected through a universal coupling to said body;

four rod members respectively mounted slidably in four holes which are formed in said body at equal intervals and in parallel and spaced apart relationship with one another and along an axial direction of the body, each of said rod members having an upper end face and a lower end face;

means for urging aid rod members toward the disc so as to hold upper end faces of said rod members in constant contact with a lower surface of the disc;

a first shaft having retaining pieces mounted on both sides thereof said retaining pieces being held in constant contact with the lower end faces of an oppositely located pair of said rod members, said first shaft having first and second ends which are journaled rotatably in said body;

a second shaft having retaining pieces mounted on both sides thereof and which are held in contact with the lower end faces of another oppositely located pair of said rod members, said second shaft having first and second ends journaled rotatably in said body said second shaft being arranged so as to not interfere with said first shaft;

a first rotational angle sensor connected to at least one of the first and second ends of said first shaft; and a second rotational angle sensor connected to at least one of the first and second ends of said second shaft.

2. An operating lever device as claimed in claim 1, characterized in that the retaining piece on one side of said first shaft projects from a portion thereof near one end of the first shaft, the retaining piece on the other side of the first shaft projects from a portion thereof near the other end of the first shaft, the retaining piece on one side of said second shaft projects from a portion near one end of the second shaft, and the retaining piece on the other side of the second shaft projects from a portion thereof near the other end of the second shaft.

3. An operating lever device as claimed in claim 1, characterized in that the retaining piece on one side of said first shaft projects with an upward slope from a portion thereof near one end of the first shaft, the retaining piece on the other side of the first shaft projects with a downward slope from a portion thereof near the other end of the first shaft, the retaining piece on one side of said second shaft projects with an upward slope from a portion thereof near one end of the second shaft, and the retaining piece on the other side of the second shaft projects with a downward slope from a portion thereof near the other end of the second shaft.

4. An operating lever device as claimed in claim 1, characterized in that each of said first and second rotational angle sensors functions as a neutral switch.

5. An operating lever device as claimed in claim 2, characterized in that the retaining pieces on both sides of said second shaft project upward by a predetermined height so as to be located at the same height as the retaining pieces of said first shaft.

6. An operating lever device as claimed in claim 3, characterized in that the retaining pieces on both sides of said second shaft project upward by a predetermined amount so as to be located at the same level as the retaining pieces of said first shaft.

7. An operating lever device comprising:

a body, said body being formed with first, second, third and fourth bores;

an operating lever;

a disc which is rigidly connected with said operating lever;

a universal coupling which operatively connects one of said operating lever and said disc to said body;

first, second, third and fourth rods reciprocally disposed in said first, second, third and fourth holes, respectively, each of said first, second third and fourth rods having an upper end and a lower end;

means for urging the upper ends of first, second, third and fourth rods into engagement with said disc;

a first shaft having first and second retaining pieces thereon said first and second retaining pieces contacting said first and second rods, respectively, said first shaft being rotatably supported on said body;

a second shaft having third and fourth retaining pieces thereon, said third and fourth retaining pieces contacting the lower ends of said third and fourth rod members, respectively, said second shaft being journaled rotatably at both ends in said body, said second shaft being disposed in spaced contact free relationship with said first shaft and so as to extend at a predetermined angle with respect to said first shaft;

a first rotational angle sensor operatively connected to said first shaft; and a second rotational angle sensor operatively connected to

8. An operating lever device comprising:

a disc member movably supported on a body of said device by universal joint means, said disc member being connected with a lever via which movement thereof can be selectively induced; 'first, second, third and fourth rods reciprocally supported by said body, said first, second, third and fourth rods each having an upper end and a lower end, the upper ends of said first, second, third and fourth rods engaging a lower surface of said disc member;

first and second shafts rotatably supported by said body, said first and second shafts being arranged in a predetermined spaced relationship with one another;

first crank means for providing an operative connection between the lower ends of said first and second rods and said first shaft and for inducing said first shaft to rotate in response to reciprocal movement being induced in said first and second rods by movement of said disc;

second crank means for providing an operative connection between the lower ends of said third and fourth rods and said second shaft and for inducing said second shaft to rotate in response to reciprocal movement being induced in said third and fourth rods by movement of said disc; and means for sensing rotational movement of said first and second shafts.

9. An operating lever device as claimed in claim 8 wherein said second crank means comprises a second member which is releasably connected to said second shaft and which has a third portion which projects outwardly from said second shaft in a first direction and is engageable with said third rod, and a fourth portion which projects outwardly from said second shaft in a second direction which is essentially the opposite of said first direction and which is engageable with said fourth rod.

10. An operating lever device as claimed in claim 9 wherein said second member is so constructed and arranged as to be selectively positionable with respect to said second shaft, wherein said third portion has a third inclined portion and wherein said fourth portion has a fourth inclined portion, said third inclined portion being arranged to abut against said third rod and said fourth inclined portion being arranged to abut against said fourth rod.

11. An operating lever device as claimed in claim 8 wherein said first crank means comprises a first member which is releasably connected to said first shaft and which has a first portion which projects outwardly from the said first shaft in a first direction and which is engageable with said first rod, and a second portion which projects outwardly from said first shaft in a second direction which is essentially the opposite of said first direction and which is engageable with said second rod.

12. An operating lever device as claimed in claim 11 wherein said first member is so constructed and arranged as to be selectively positionable with respect to said first shaft, wherein said first portion has a first inclined portion and wherein said portion has a second inclined portion, said first inclined portion being arranged to abut against said first rod and said second inclined portion being arranged to abut against said second rod.

13. An operating lever device as claimed in claim 12, wherein said first member forms part of a first clearance adjusting means for permitting any undesirable clearances between the first and second portions and said first and second rods, respectively, to be adjusted.

14. An operating lever device as claimed in claim 12, wherein said second member forms part of a second clearance adjusting means for permitting undesirable clearances between the third and fourth portions and said third and fourth rods, respectively, to be adjusted.

* * * * *